United States Patent [19]

Dresden

[11] Patent Number: 4,972,634

[45] Date of Patent: Nov. 27, 1990

[54] PORTABLE WALLING

[76] Inventor: Gregory M. Dresden, 54 Cameo Dr., Apt. 2, Chico, Calif. 95926

[21] Appl. No.: 300,117

[22] Filed: Jan. 19, 1989

[51] Int. Cl.[5] ..... E04B 2/82

[52] U.S. Cl. ..... 52/69; 52/71; 52/202; 52/221; 52/243.1; 52/309.4

[58] Field of Search ..... 52/69, 71, 64, 221, 52/144, 202, 238.1, 243.1, 309.4, 240, 239

[56] References Cited

U.S. PATENT DOCUMENTS

| | | | |
|---|---|---|---|
| 1,975,470 | 10/1934 | McInerney | 52/243.1 |
| 2,949,983 | 8/1960 | Gartner | 52/243.1 |
| 3,062,316 | 11/1962 | Watters . | |
| 3,421,459 | 1/1969 | Sherwood | 52/64 |
| 4,047,337 | 9/1977 | Bergstrom . | |
| 4,057,123 | 11/1977 | Erickson . | |
| 4,155,211 | 5/1979 | Saylor . | |
| 4,186,534 | 2/1980 | Le Coze | 52/243.1 |
| 4,263,761 | 4/1981 | Kristoff | 52/64 |
| 4,372,086 | 2/1983 | Hanlon | 52/71 |
| 4,493,174 | 1/1985 | Arens | 52/221 |
| 4,503,655 | 3/1985 | Yeager et al. | 52/202 |
| 4,638,614 | 1/1987 | Wilcox | 52/238.1 |
| 4,704,837 | 11/1987 | Menchetti | 52/71 |
| 4,713,918 | 12/1987 | Cioffi | 52/221 |

FOREIGN PATENT DOCUMENTS

| | | | |
|---|---|---|---|
| 246344 | of 1960 | Austria | 52/71 |
| 2551886 | 5/1977 | Fed. Rep. of Germany | 52/309.4 |

*Primary Examiner*—David A. Scherbel
*Assistant Examiner*—Caroline D. Dennison

[57] ABSTRACT

A portable wall assemblage is provided in a multiple of interlocking rigid panels. The portable walling can be removably affixed immediately adjacent an interior wall without the use of nail or screws. Each interlocking rectangular panel is formed of a fire retardant, acoustical material which can be trimmed with a household utility knife. One side of the panel is affixed with a thin layer of decorated paper or fabric for aesthetic purposes while the other side of the panel supports peripheral ridges which space the panel from the wall surface. These ridges against the wall produce an enclosed air space which provides an added measure of sound absorbtion. A central transverse seam allows folding of each panel for easy storage and transportation. Spring biased U-shaped capping brackets on the top edge of each panel provides pressure type frictional maintenance of the assembled panels vertically between the ceiling and floor of a room. The panel assemblage can be free standing or placed flush against the wall. Accessory attachments are provided for accessing electrical outlets.

9 Claims, 5 Drawing Sheets

PORTABLE WALLING

BACKGROUND OF THE INVENTION

1. Field of the Invention:

This invention relates to portable walls. The invention is particularly directed towards decorated lightweight interior wall sections positionable in desired locations to produce temporary closures, to reduce or eliminate noise, and to provide an added measure of thermal insulation. The wall covering of the immediate invention is provided in foldable sectioned panels which can be easily trimmed to a desired size. A particular method of spring biasing allows placing the portable wall immediately adjacent a permanent wall or in any location where upper and lower support common to a standard sized household room is available. No attachment nails or screws are required.

2. Description of the Prior Art:

A variety of devices have been developed over the years in an attempt to solve the problem of noise pollution originating from both within a building and from without. Noise generated from within a building, such as that experienced in factories and large business offices can be annoying and distracting to the workers. Free standing room dividers or acoustical partitions have been in use in offices for some time and have been effective in reducing the volume of the noise. The free standing acoustical room dividers however, are primarily directed at reducing noise generated from the room in which they are situated, but do not significantly effect noise originating from adjacent rooms or buildings. This type of noise pollution is most often experienced by people living in large apartment complexes where a common wall is shared by two or more individual dwelling units. Thermal insulation applied to exterior walls helps to reduce noise originating from outside the building, but interior walls however are seldom insulated. This creates a less than effective acoustical barrier between the two apartments. Acoustical wall paneling applied to the adjacent wall itself would be a more direct means of reducing or eliminating this form of noise. Most apartment complexes owners and managers view this as an unnecessary expense. They also try to prevent the renter from installing devices of his own which are permanent or mar the surface of the ceiling or walls. To avoid this the use of an acoustical wall paneling which is free standing or does not damage the wall finish during installation is necessary. Free standing or permanently mounted vertical acoustical panels are available but a portable wall with the uniqueness and versatility of the present invention is not found. Examples of past art offerings are seen in patents issued to Watters, Bergstrom, Erickson and Saylor, U.S. Pat. Nos. 3,062,316, 4,047,337, 4,057,123, and 4,155,211 respectfully. Some of these devices have support legs or stands for allowing free standing formation inside a room but provide no means for direct placement against a wall other than permanent brackets using nails or screws. Support stands provided in the past art devices appear to be extending braces which prevent the wall panel from being positioned in close proximity to the wall. Even with back portions of the support brace severed to allow abutment against the wall, there still would be an outward forward extension of the support brace which could interfere with foot traffic and would reduce the aesthetic appearance of the panels. Other devices disclosed have narrow support legs with no means for preventing the wall panels from falling over once they are aligned in a straight row against a vertical wall. The existence of support legs also exposes an area of the wall which is unprotected by the acoustical paneling, limiting the sound proofing effect. Several of the past art devices describe panels comprised of materials which would be difficult to cut to a desired size without special tools. Others had support frames which prevent custom alteration. No provisions were seen in past art devices for accessing various wall fixtures such as electrical switches and electrical outlets. Most importantly, none of the previously mentioned devices describe wall panels which can be removably applied to the wall without marring the wall surface. Many of the past art devices also require assembly and installation with conventional or specialized tools by one skilled in the art and would prove difficult for the common layman to master. A majority of the disclosed devices are provided in large, framed sections which are cumbersome and difficult to transport by the conventional apartment dweller.

Therefore, in the immediate invention, I overcomes the described disadvantages seen in the past art by providing portable walling both acoustical and plain having a aesthetic wall covering which folds for storage and opens for use. The walling is held upright in place by special spring biasing without needing a foot arrangement as is described fully further on in the following specification.

SUMMARY OF THE INVENTION

In practicing my invention, I have developed a portable walling which folds and is quick and easy to install. The walling is structured for acoustical and for plain wall applications. Interlocking panels can be applied directly against the wall without the use of nails or other hardware that might mar the wall surface. This is accomplished by using a unique system of covered spring biasing in brackets positioned over the top edge of the assembled panels. An elongated narrow panel or molding is removably affixed to the outer front surface of each bracket. This gives a finished look to the assembled structure and serves as an additional means of interlocking the bracing for the assembled panels. Each panel is sized for an unfolded height of eight feet to accommodate the conventional ceiling height found in most homes. The application of the brackets can increase this height slightly but is usually applicable in most situations. The spring-biased brackets allow a friction-type attachment of the assembled panels to ceiling and floor immediately adjacent a wall which will not damage the surface of the wall or ceiling. The front surface of the panels are affixed with a decorative layer of fabric or paper which adds an aesthetic measure to the device and a small measure of added sound absorption. The back surface of each panel has a peripheral ridge suspending the panel away from the wall to provide an enclosed air space. This enclosed air space also provides a measure of acoustical sound proofing. The relatively soft material of which the device is structured allows the panels to be cut with a conventional household utility knife. The wall panels can now be custom fitted to any size wall regardless of shape or size. Each panel has a centerfold seam which allows folding for easy shipment and storage.

Therefore it is a primary object of my invention to provide in portable walling a plain or an acoustical wall assemblage which reduces noise originating from interior and exterior areas adjacent the respective wall.

A further object of my invention is to provide a removable acoustical wall assemblage which can be releasably affixed to an interior wall without the use of nails or screws and without damaging the surface of the wall or ceiling.

A still further object of my invention is to provide an acoustical wall assemblage which can be trimmed and shaped for a custom fit to any existing wall.

Another object of my invention is to provide an acoustical wall assemblage having a variety of exterior decorator finishes which provide an aesthetic appearance.

An even further object of my invention is to provide an acoustical wall assemblage in conveniently small foldable units which are easy to store, transport and assemble.

Other objects and advantages of my invention will become apparent with a reading of the specification and comparing the numbered parts described with similarly numbered parts illustrated in the accompanying drawings.

DESCRIPTION OF THE PREFERRED EMBODIMENTS

Figure 1:
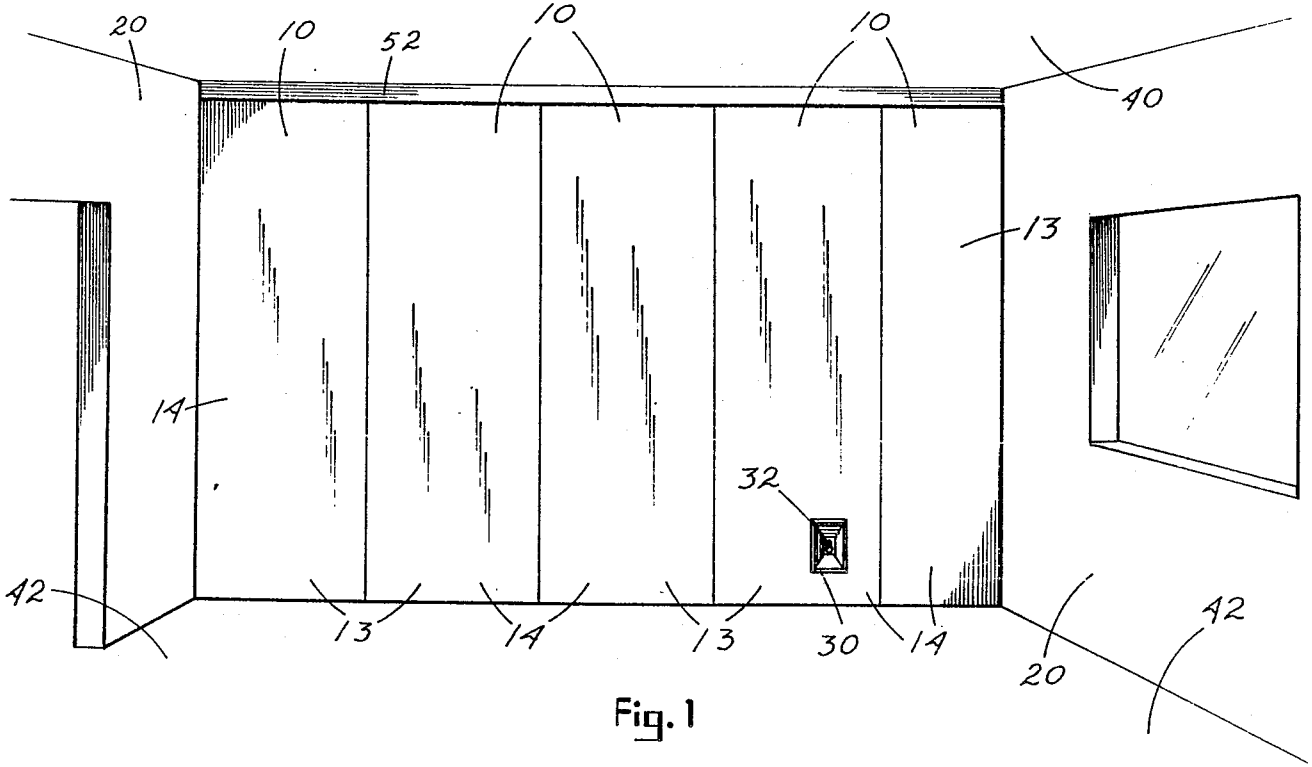
FIG. 1 is a frontal view of the assembled acoustical wall panels in use.
Figure 2:
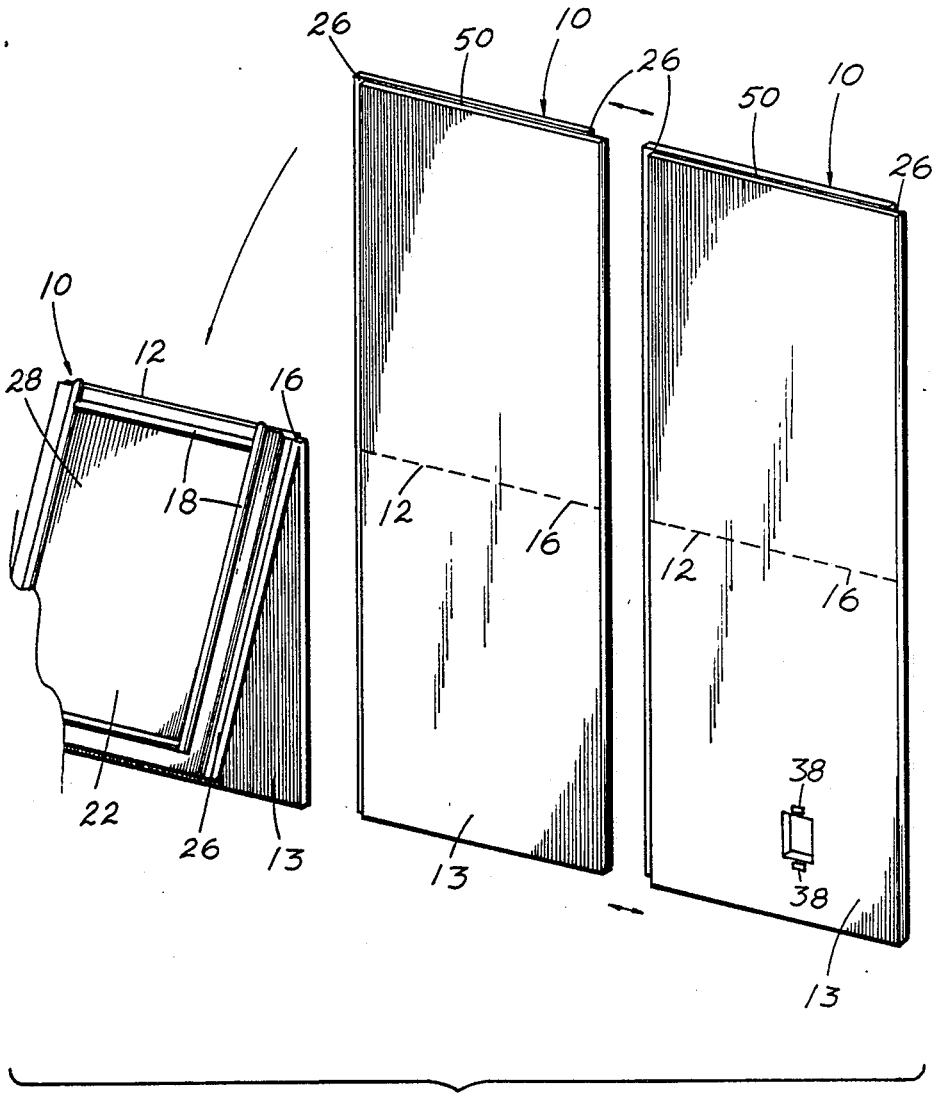
FIG. 2 is a frontal perspective view of three unassembled panels illustrating the vertical lateral rabbet attachment joints, and the central transverse seam forming a living hinge which allows each panel to be folded, as seen in the panel on the left.
Figure 3:
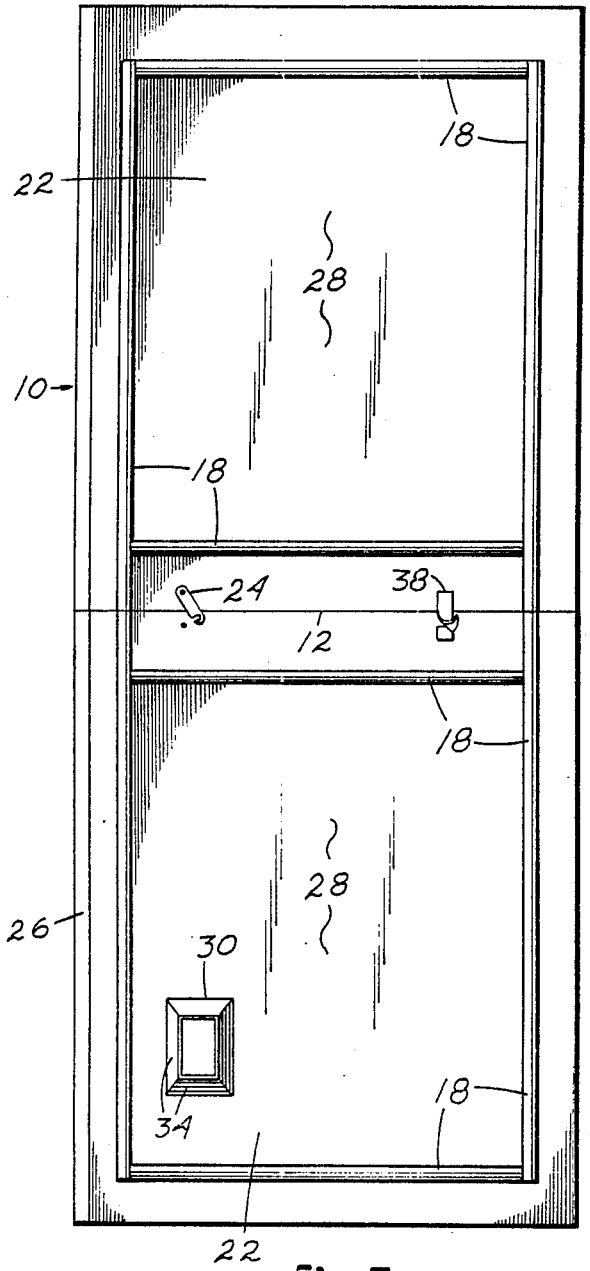
FIG. 3 is a rear view of one panel showing the peripheral ridges, two forms of attachment means for securing the panel in a vertical position, and an electrical outlet adaptor plate.
Figure 4:
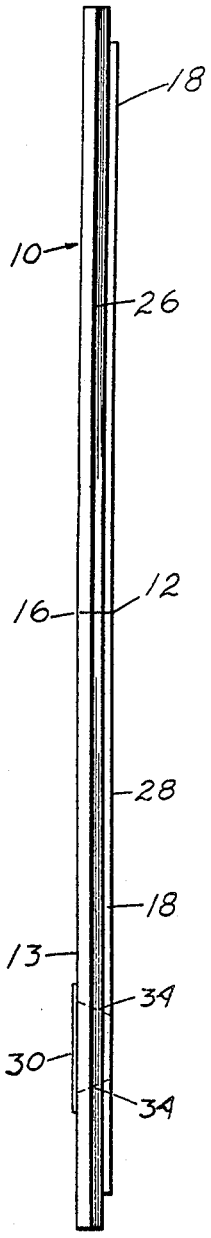
FIG. 4 is a left side view of one panel showing the lateral rabbet attachment joints and the peripheral ridges with the dotted outline representing the electrical outlet adaptor plate.
Figure 5:
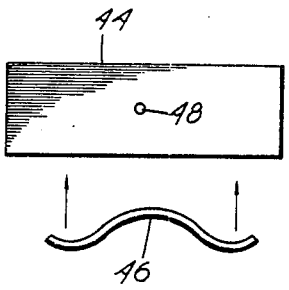
FIG. 5 is a frontal view of the spring-biased bracket with the flat spring positioned beneath the bracket.
Figure 6:
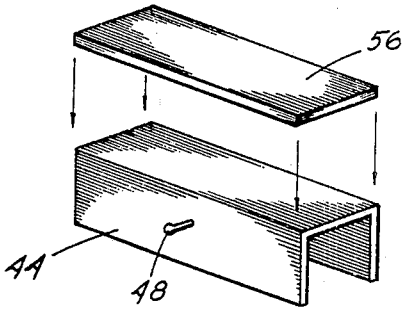
FIG. 6 is a perspective view of the spring-biased bracket with the optional protective padding positioned above the bracket.
Figure 7:
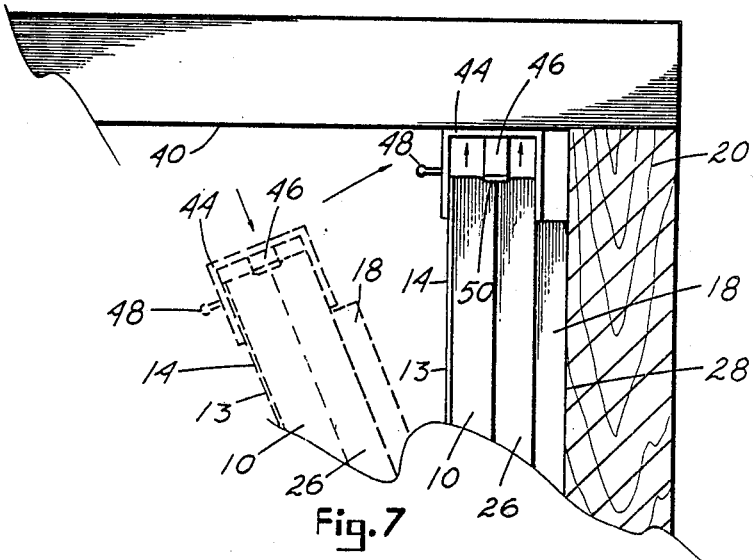
FIG. 7 is a side view of the top section of an assembled panel with attached bracket. The dotted outline shows the bracket in the retracted position before attachment against the ceiling beam and sectioned side wall.
Figure 8:
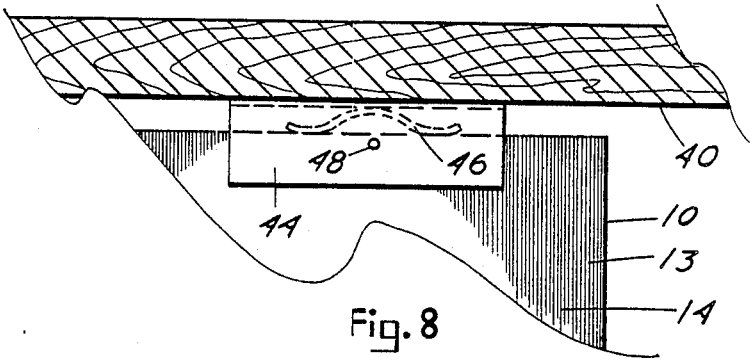
FIG. 8 is a frontal view of the assembled panel and bracket. The dotted outline shows the position of the flat spring applying tension between the ceiling through the bracket to the top edge of the panel.
Figure 9:
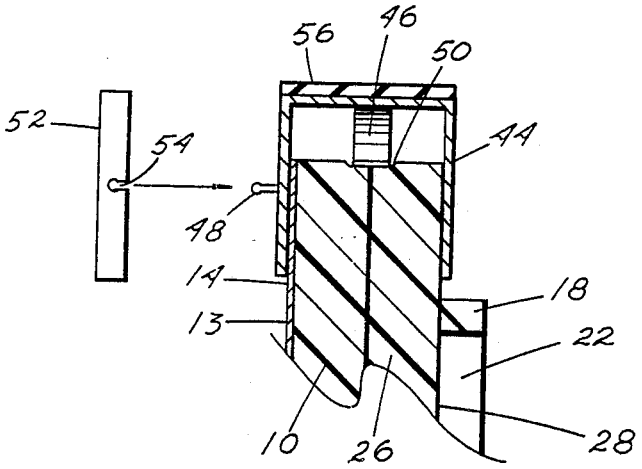
FIG. 9 is an enlarged side view of the bracket and top section of the panel with the molding positioned for attachment to the front surface of the bracket.
Figure 10:
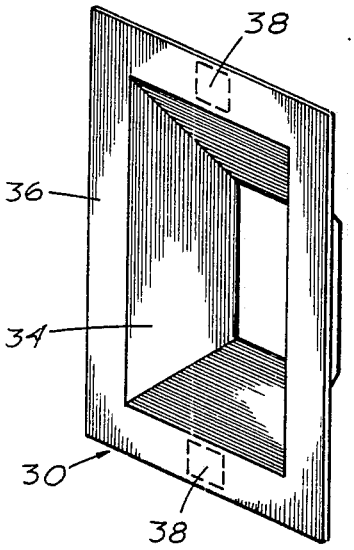
FIG. 10 is a perspective view of the electrical outlet adaptor plate with the dotted outlines representing a velcro-type attachment means.
Figure 11:
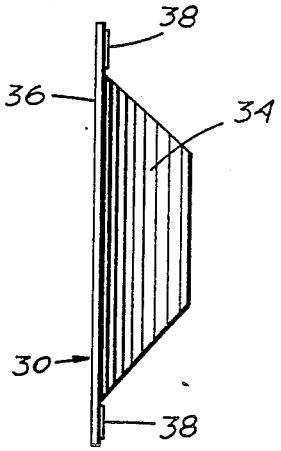
FIG. 11 is a left side view of the electrical outlet adaptor plate.

Referring now to the drawings where the preferred embodiment of the invention is illustrated. The portable walling comprising the immediate invention is an assemblage of separate interlocking foldable rectangular panels 10. Although described in the specification and shown in the drawings as rectangular in form, panel 10 can be structured in any suitable shape. The composition of panel 10 consists of any material having efficient acoustical capabilities, having fire retardant qualities, having a good rigidity, and being a material which can be severed with a knife. One such suitable material is a rigid lightweight plastic foam. Normally, each panel 10 is sized slightly less than eight feet in height, three feet in width, and from one to three inches in thickness dependent upon applicative requirements. Although panel 10 can be a one-piece panel, in the preferred embodiment panel 10 is essentially centrally folded at transverse fold seam 12 and a living hinge 16 holds the two sections together at fold seam 12. Although panels 10, alone or assembled, can stand free as effective room dividers, panels 10 are principally structured as acoustical walls for positioning against an existing wall to reduce sound passage from one room to another. For the wall-to-wall application, panel 10 is illustrated from a wall facing side, back surface 28, and from a room facing side, front surface 13. For aesthetic enhancement, an outer layer of tough, durable material, decorative covering 14, is affixed to the front surface 13 side of panel 10. Decorative covering 14 reinforces living hinge 16 over fold seam 12 which allows panel 10 to be folded in half. Although the foldable feature of each panel 10 allows for easier storage and transportation, panel 10 can be structured without fold seam 12 and function equally as well. Back surface 28 of panel 10, opposite of front surface 13 and decorative covering 14, supports peripheral suspension ridge 18. Suspension ridge 18 consists of a narrow rib formed inherently with panel 10, which is positioned a short distance from all outer peripheral edges, including those of fold seam 12. Suspension ridges 18 suspend the back surface 28 of panel 10 a short distance from wall 20, thereby creating dead airspace 22. Airspace 22 augments the acoustical abilities of panel 10. Fold seam 12 is affixed with hook fasteners 24 on the back surface of panel 10, which helps to hold fold seam 12 in a closed position. Two different forms of fasteners are shown in FIG. 3 which can be hook fasteners 24 or hook and loop style fasteners 38. The lateral vertical sides of panel 10 are affixed with attachment means which allows releasable side to side linear attachment of a multiple of panels 10. This attachment means is formed by mating or correlating sections of rabbet joints 26 formed along the length of each side of panel 10, best shown in FIG. 2. Other releasible joints, such as mortise and tenon, can also be effectively used. Electrical outlet adaptor plate 30 is provided for accessing electric outlets 32 which would otherwise be covered by panel 10. Electrical outlet adaptor plate 30 is comprised of an opened bottom box-like structure having four inwardly beveled sides 34 and a flat outer frame 36 connected at a right angle to beveled sides 34, best seen in FIG. 10 and 11. The width of beveled sides 34 are sufficient to extend through an aperture in panel 10 and abut the edges of electrical outlet 32. The aperture must be custom made for the size and location of the user's electrical outlets 32 on wall 20. Small sections of hook and loop style fasteners 38 are affixed to the back surface of frame 36 and correlating sections are affixed to decorative covering 14 of panel 10 for secure attachment of electrical outlet adaptor plate 30. Adaptive plates and frames for electrical switch plates, windows, doors and other wall projections are also anticipated.

Releasable attachment of assembled panels 10 between ceiling 40 and floor 42 is accomplished with a frictional or pressure fitting using bracket 44 and spring biasing provided by flat spring 46, shown in FIGS. 5 through 9. Bracket 44 is an elongated U-shaped channel which is sized to fit over the top edge of panel 10, best seen in FIG. 9. One side of bracket 44 supports a short post, snap attachment 48, which will be further explained below. Flat spring 46 is an elongated rectangular curved metal band which when placed lengthwise, provides a spring biased support between the top and bottom adjacent surfaces. Flat spring 46 is positioned lengthwise inside of bracket 44 with the curved surface facing upwards. Bracket 44 and inserted flat spring 46 are placed over the top edge of the assembled panels 10, preferably at the junction of the connecting rabbet joints 26. Placement in this area provides additional linear support for the assembled panels 10. A narrow lengthwise groove located on the top surface of each panel 10, spring retaining groove 50, is sized for receiving the distal ends of flat spring 46. Spring retaining groove 50 helps to insure correct placement of flat spring 46 and allows lengthwise movement.

In use, panels 10 are assembled, preferably flat on floor 42, and sized according to the measurements of wall 20. Should the assembled length of panels 10 prove too long, the excess can be trimmed off with a conventional utility knife. The edge which is cut should be the far left or right edge of the assembled panels 10 since removal of rabbet joints 26 would not prove to be a problem on the distal ends. Should the ceiling 40 height be less than eight feet, additional trimming of the bottom edge of the assembled panels 10 would also be required. Brackets 44, and flat springs 46, are then placed over the top edge of panels 10, preferably over rabbet joints 26. All brackets are then connected by retaining molding 52. Retaining molding 52 is an elongated panel having a central lengthwise channel incorporated into the back side known as snap attachment retaining channel 54. Snap attachment retaining channel 54 is sized to releasably retain the distal end of snap attachment 48 located on the front surface of bracket 44. Retaining molding 52 is adapted for the length of wall 20 and then snapped onto brackets 44 over snap attachments 48. Retaining molding 52 not only serves to further stabilize assembled panels 10 in a linear fashion, but provides an aesthetic finishing touch by covering brackets 44. To install the assembled panels 10 against wall 20, all panels 10 are raised to a vertical position parallel to wall 20. With the addition of brackets 44 to panels 10, a combined height of more than eight feet is attained. The bottom edge of all panels 10 is positioned against the bottom of wall 20. Pressure is applied downward on the top surface of brackets 44 by pulling downward on the front surface of retaining molding 52. Flat spring 46 is then compressed sufficiently to reduce the height of assembled panels 10 with brackets 44 to less than eight feet or less than the height of ceiling 40, represented by the dotted outline in FIG. 7. The top edge of the assembled panels 10 can now be pressed against wall 20 with suspension ridges 18 abutting wall 20, also seen in FIG. 7 and 8. Retaining molding 52 is then released, allowing flat spring 46 to expand, which raises the top surface of bracket 44 to abut with ceiling 40. Flat spring 46 is now applying sufficient tension against bracket 44 or ceiling 40 and panels 10 to provide stable yet releasable attachment of the assembled panels 10 to wall 20. An optional layer of protective padding 56, shown in FIG. 6 and 9, can be applied to the top surface of bracket 44 to prevent damage to ceiling 40 and provide better traction.

Although not shown, it is obvious to one skilled in the art that a single elongated bracket 44 can be used to replace the several smaller multiple brackets 44. Retaining molding 52 and snap attachment 48 could also be eliminated. Flat spring 46 could be eliminated and replace with spring biasing which is inherently incorporated into the top surface of the elongated bracket 44. This could be accomplished by cutting several elongated tabs into the top surface which could be angled downward and curved to provide an inherent upside down flat spring 46. This alternative to bracket 44 as well as the existing brackets 44 can also be positioned on the bottom or side edges of the assembled panels 10. Side positioning would necessarily require additional top and or bottom bracing to keep the assembled panels 10 in linear alignment. Bottom positioning would be more convenient if ceiling 40 contained multiple exposed beams.

Although I have described my invention in detail in the preceding specification and disclosed several alterations to my device, it is obvious that one skilled in the art could make further modification to my invention of a practical nature, therefore, I consider my invention to be the immediate invention heretofore describes and any modifications thereto which fall within the spirit and intended scope of the appended claims.

What I claim as my invention is:

1. Portable walling, comprising:

a. at least one substantially rectangular planar panel; said panel having at least one edge affixed with interlocking attachment means allowing edgeward linear abutted attachment of a multiple of said panel;

said panel foldable along at least one fold seam;

said panel having at least one outer layer of flexible material affixed to one side forming a living hinge over said fold seam with the opposite side of said panel supporting a series of continuous peripheral ridges located adjacent outside edges of said panel and on both sides of said fold seam;

b. means for locking said fold seam rigid with said panel in an unfolded position;

c. means for spring biased support on at least one edge of said panel capable of causing frictional stable positioning of said panel against a wall;

d. means for accessing electrical outlets through said panel.

2. The portable walling of claim 1 wherein said means for spring biased support is, in combination, at least one U-shaped bracket and spring, said bracket sized for movable capping over at least one edge of said panel, said spring sized for insertion inside of said bracket.

3. The portable walling of claim 1 wherein said means for accessing electrical outlets through said panel is an opening in said panel with an insertable framing therefor.

4. The portable walling of claim 1 wherein said means for locking said fold seam rigid with said panel in said unfolded position is hook and loop fasteners pulled tightly crossed said fold seam on the opposite side of said panel from said flexible material.

5. Portable walling, comprising:

a. at least one substantially rectangular planar panel;

said panel foldable along at least one fold seam;

said panel having at least one outer layer of flexible material affixed to one side forming a living hinge over said fold seam;

b. means for locking said fold seam rigid with said panel in an unfolded position;

c. means for spring biased support on at least one edge of said panel capable of causing frictional stable positioning of said panel between two interior structures of a building.

6. The portable walling of claim 5 wherein said means for spring biased support is, in combination, at least one U-shaped bracket and spring, said bracket sized for movable capping over an upper said one edge of said panel, said spring sized for insertion inside of said bracket.

7. The portable walling of claim 5 wherein said two interior structures of a building are the floor and ceiling, of said building.

8. The portable walling of claim 5 wherein said means for locking said panel rigid in said unfolded position is hook and loop fasteners pulled tightly crossed said fold seam on the opposite side of said panel from said flexible material.

9. The portable walling of claim 5 wherein said panel is manufacture of lightweight rigid plastic foam.

* * * * *